US007001315B1

(12) United States Patent
Diodati

(10) Patent No.: US 7,001,315 B1
(45) Date of Patent: Feb. 21, 2006

(54) PORTABLE EXERCISE KIT

(76) Inventor: Daniel J. Diodati, 9881 Del Mar, San Ramon, CA (US) 94583

( * ) Notice: Subject to any disclaimer, the term of this patent is extended or adjusted under 35 U.S.C. 154(b) by 475 days.

(21) Appl. No.: 10/294,921

(22) Filed: Nov. 15, 2002

(51) Int. Cl.
*A63B 21/02* (2006.01)

(52) U.S. Cl. ..... 482/121; 482/51; 482/104; 482/23

(58) Field of Classification Search ..... 482/121, 482/51, 15, 92, 23, 907, 904, 104; 190/18; 206/16
See application file for complete search history.

(56) References Cited

U.S. PATENT DOCUMENTS 2,531,550 A * 11/1950 Bradley et al. ..... 206/317
5,447,216 A * 9/1995 Freyvogel ..... 190/18 A
5,697,870 A * 12/1997 Osborn ..... 482/52

* cited by examiner

*Primary Examiner*—Gregory L. Huson
*Assistant Examiner*—L. Amerson

(57) ABSTRACT

A portable exercise kit for providing easily transportable exercise equipment and accessories. The portable exercise kit includes a case assembly including a container having a first cover and a second cover being hingedly attached to said first cover, and also including a handle being attached to the container, and further including wheels being attached to the container for moving the container upon a ground; and also includes padded liner inserts being attached to the first and second covers in the container; and further includes an assembly for latching the first and second covers together; and also includes exercise equipment/accessories being removably disposed in the container.

1 Claim, 4 Drawing Sheets

PORTABLE EXERCISE KIT

BACKGROUND OF THE INVENTION

1. Field of the Invention

The present invention relates to exercise kits and more particularly pertains to a new portable exercise kit for providing easily transportable exercise equipment and accessories.

2. Description of the Prior Art

The use of exercise kits is known in the prior art. More specifically, exercise kits heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,697,870; U.S. Pat. No. 4,856,775; U.S. Pat. No. 4,431,185; U.S. Pat. No. 3,117,781; U.S. Pat. No. 5,813,953; U.S. Pat. No. 6,068,580; U.S. Pat. No. 6,145,719; U.S. Pat. No. 2,531,550; and U.S. Pat. No. Des. 336,984.

While these devices fulfill their respective, particular objectives and requirements, the aforementioned patents do not disclose a new portable exercise kit. The inventive device includes a case assembly including a container having a first cover and a second cover being hingedly attached to said first cover, and also including a handle being attached to the container, and further including wheels being attached to the container for moving the container upon a ground; and also includes padded liner inserts being attached to the first and second covers in the container; and further includes an assembly for latching the first and second covers together; and also includes exercise equipment/accessories being removably disposed in the container; and combines fitness equipment in a container which can be easily transported with the user from place to place, features not described nor suggested in any of the prior art.

In these respects, the portable exercise kit according to the present invention substantially departs from the conventional concepts and designs of the prior art, and in so doing provides an apparatus primarily developed for the purpose of providing easily transportable exercise equipment and accessories.

SUMMARY OF THE INVENTION

The general purpose of the present invention, which will be described subsequently in greater detail, is to provide a new portable exercise kit apparatus and method which has many of the advantages of the exercise kits mentioned heretofore and many novel features that result in a new portable exercise kit which is not anticipated, rendered obvious, suggested, or even implied by any of the prior art exercise kits, either alone or in any combination thereof.

There has thus been outlined, rather broadly, the more important features of the portable exercise kit in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable exercise kit apparatus and method which has many of the advantages of the exercise kits mentioned heretofore and many novel features that result in a new portable exercise kit which is not anticipated, rendered obvious, suggested, or even implied by any of the prior art exercise kits, either alone or in any combination thereof.

Still another object of the present invention is to provide a new portable exercise kit for providing easily transportable exercise equipment and accessories.

Still yet another object of the present invention is to provide a new portable exercise kit that allows the user to take one's exercise equipment and accessories along wherever the user goes.

Even still another object of the present invention is to provide a new portable exercise kit that also allows the user to organize and safe-keep one's exercise equipment and accessories.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
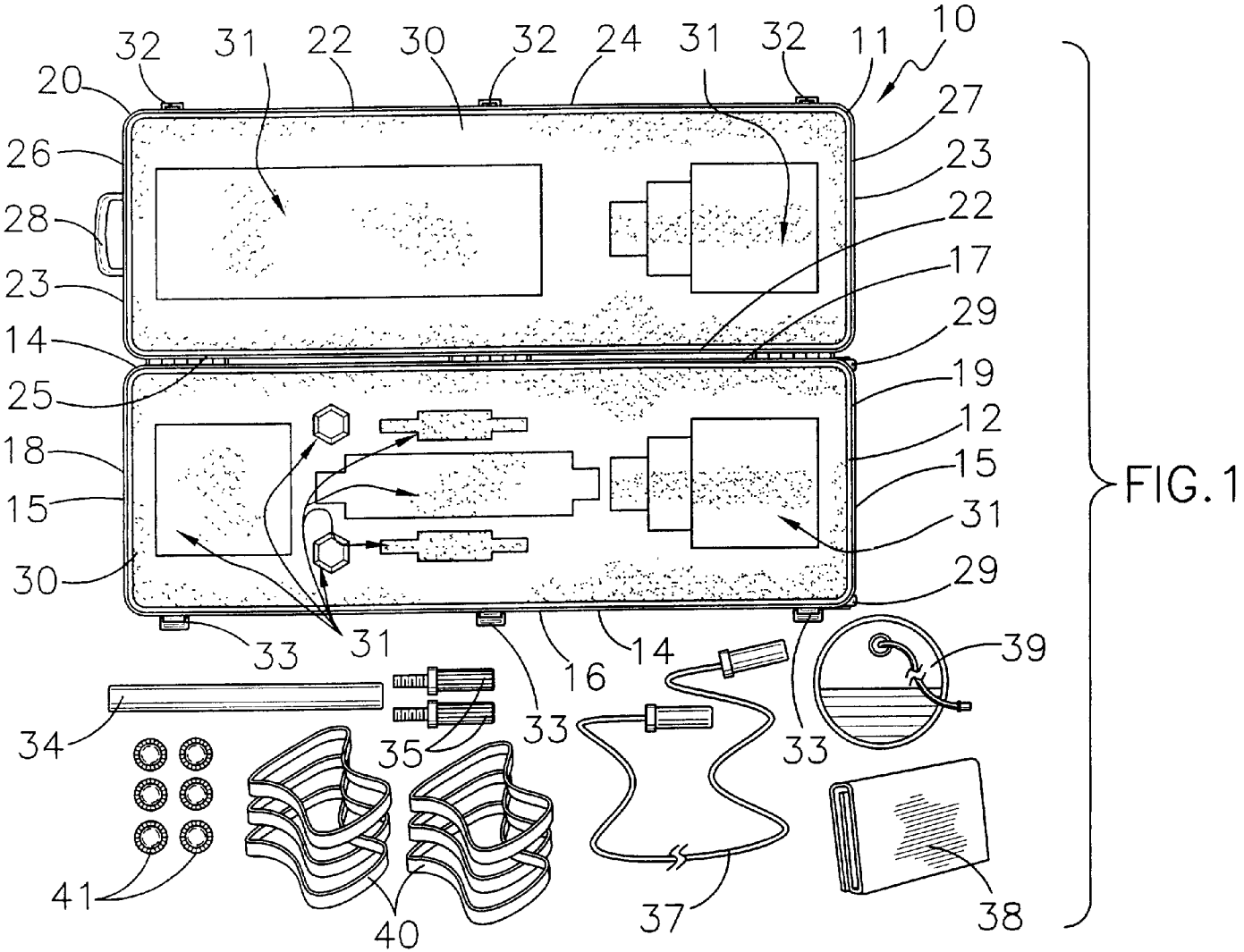
FIG. 1 is an exploded front elevational view of a new portable exercise kit according to the present invention.
Figure 2:
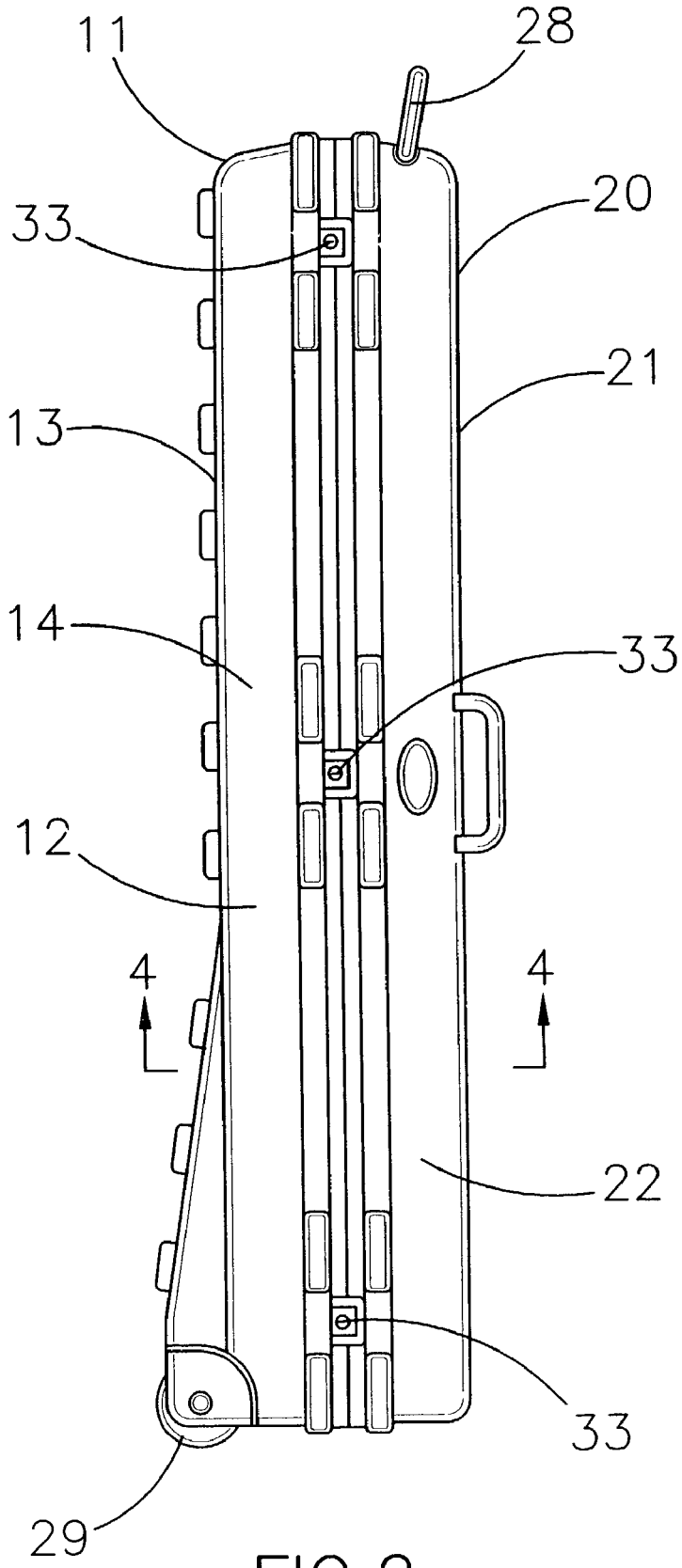
FIG. 2 is a side elevational view of the case of present invention.
Figure 3:
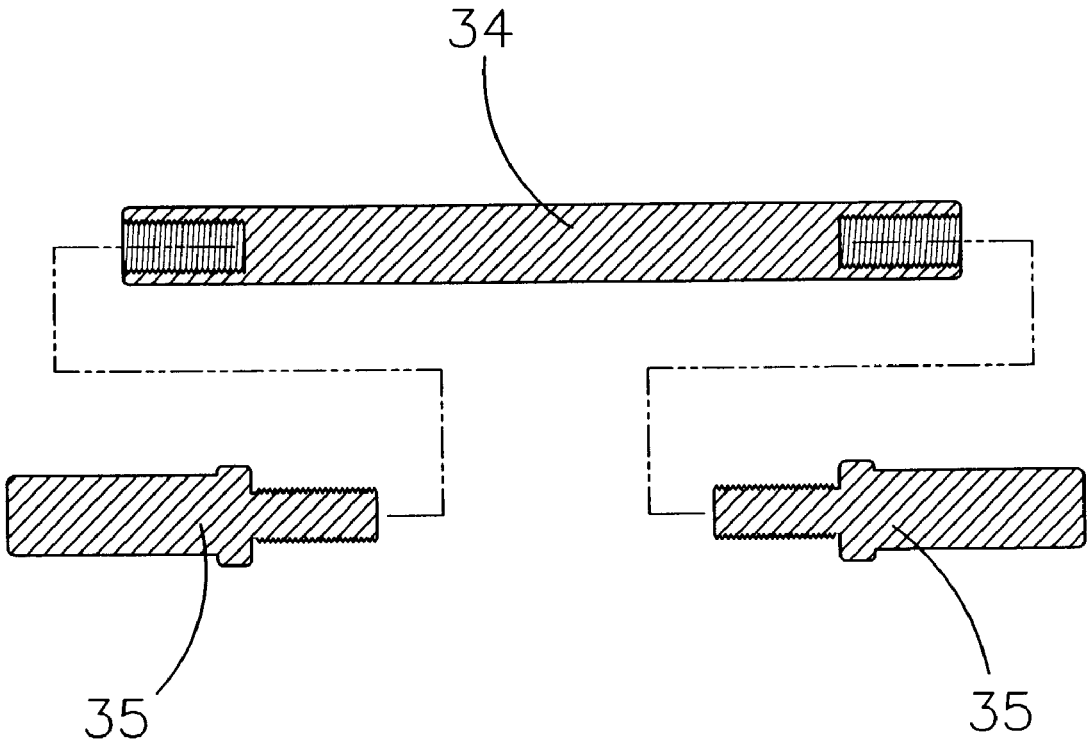
FIG. 3 is an exploded cross-sectional view of a dumbbell bar member and handle members of the present invention.
Figure 4:
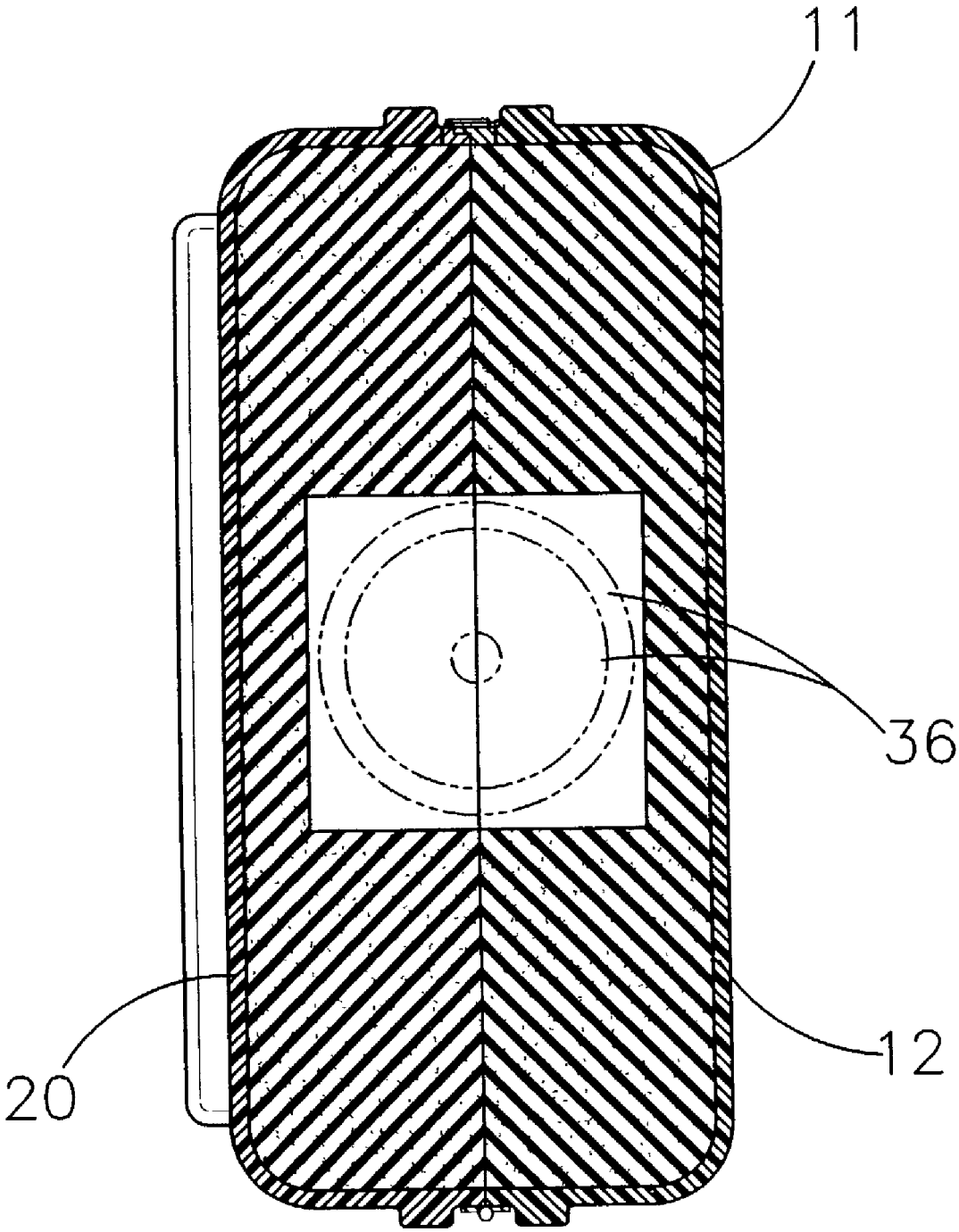
FIG. 4 is a cross-sectional view of the case of the present invention.

With reference now to the drawings, and in particular to FIGS. 1 through 4 thereof, a new portable exercise kit embodying the principles and concepts of the present invention and generally designated by the reference numeral 10 will be described.

As best illustrated in FIGS. 1 through 4, the portable exercise kit 10 generally comprises a case assembly including a container 11 having a first cover 12 and a second cover 20 being hingedly attached to the first cover 12, and also including a handle 28 being conventionally attached to the container 11, and further including wheels 29 being conventionally attached to the container 11 for moving the container 11 upon a ground. The first cover 12 includes bottom, side and end walls 13–15 and an open top, and the second cover 20 includes top, side and end walls 21–23 and an open bottom. Each of the first and second covers 12,20 also includes first and second longitudinal edges 16,17, 24,25 and front and rear edges 18,19,26,27. The first and second covers 12,20 are hingedly attached to one another along the second longitudinal edges 17,25. The wheels 29 are conventionally attached to the bottom wall 13 and near one of the end walls 15 of the first cover 12. The handle 28 is securely and conventionally attached to one of the end walls 23 of the second cover 20.

Padded liner inserts 30 are conventionally attached to the first and second covers 12,20 in the container 11. The padded liner inserts 30 are disposed upon inner sides of the front, bottom, side and end walls 13–15,21–23 of the first and second covers 12,20. Each of the padded liner inserts 30 includes a plurality of recessed portions 31 being disposed therein.

A means for latching the first and second covers 12,20 together includes a plurality of catch members 32 being securely and conventionally attached along the first longitudinal edge 24 of one of the first and second covers 20, and also includes a plurality of latches 33 being hingedly and conventionally attached along the first longitudinal edge 16 of one of the first and second covers 12 for engaging the catch members 32 to securely close and lock the container 11.

Exercise equipment/accessories are removably disposed in the container 11. The exercise equipment/accessories includes at least one dumbbell bar 34 being removably disposed in a selected one of the recessed portions 31 of the padded liner inserts 30, and also includes handle members 35 being threaded into ends of the at least one dumbbell bar 34 and being removably disposed in selected recessed portions 31 of the padded liner inserts 30, and further includes a plurality of weight members 36 being removably disposed in other selected recessed portions 31 of the padded liner inserts 30 and being removably mounted upon the at least one dumbbell bar 34 using fasteners 41, and also includes a jump rope 37, an inflatable exercise ball 38, a pump member 39, and a plurality of elastic band members 40 being removably disposed in yet other selected recessed portions 31 of the padded liner inserts 30.

In use, the user opens the container 11 and removes the exercise equipment/accessories from the recessed portions 31 of the padded liner inserts 30, and upon completion of one's fitness routine, the user restores the exercise equipment/accessories in the container 11, and wheels and transports the portable exercise kit 10 upon the ground as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable exercise kit. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable exercise kit comprising:

a case assembly including a container having a first cover and a second cover being hingedly attached to said first cover, and also including a handle being attached to said container, and further including wheels being attached to said container for moving said container upon a ground, said first cover including bottom, side and end walls and an open top, and said second cover includes top, side and end walls and an open bottom, each of said first and second covers also including first and second longitudinal edges and front and rear edges, said first and second covers being hingedly attached to one another along said second longitudinal edges;

padded liner inserts being attached to said first and second covers in said container, said padded liner inserts being disposed upon inner sides of said front, bottom, side and end walls of said first and second covers, each of said padded liner inserts including a plurality of recessed portions disposed therein;

a means for latching said first and second covers together; and exercise equipment/accessories being removably disposed in said container, said exercise equipment/accessories including at least one dumbbell bar being removably disposed in a selected one of said recessed portions of said padded liner inserts, and also including handle members being removably threaded into ends of said at least one dumbbell bar and being removably disposed in selected said recessed portions of said padded liner inserts, and further including a plurality of weight members being removably disposed in other selected said recessed portions of said padded liner inserts and being removably mounted upon said at least one dumbbell bar using fasteners, and also including a jump rope, an inflatable exercise ball, a pump member, and a plurality of elastic band members being removably disposed in yet other selected said recessed portions of said padded liner inserts.

* * * * *